United States Patent [19]

Jones

[11] Patent Number: 4,985,940

[45] Date of Patent: Jan. 22, 1991

[54] URINAL FOR USE BY FEMALE INDIVIDUALS

[76] Inventor: Kathie K. Jones, 5764 Red Cedar St., Pensacola, Fla. 32507

[21] Appl. No.: 439,068

[22] Filed: Nov. 17, 1989

[51] Int. Cl.[5] ..... E03D 13/00; A47K 11/00

[52] U.S. Cl. ..... 4/301; 4/144.1; 4/463

[58] Field of Search ..... 4/301, 310, 311, 462, 4/463, 144.1, 144.2, 144.3, 144.4

[56] References Cited

U.S. PATENT DOCUMENTS

| | | | |
|---|---|---|---|
| 102,416 | 4/1870 | Males | 4/301 |
| 1,328,445 | 1/1920 | Newton | 4/302 |
| 3,034,151 | 5/1962 | Filliung | 4/301 |
| 3,500,480 | 3/1970 | Michal, Jr. | 4/144.4 |
| 4,137,579 | 2/1979 | Soler | 4/144.3 |
| 4,145,768 | 3/1979 | Chevrette | 4/144.1 |
| 4,345,341 | 8/1982 | Saito | 4/301 |
| 4,683,598 | 8/1987 | Jones | 4/301 |
| 4,750,219 | 6/1988 | Williams | 4/144.1 |

FOREIGN PATENT DOCUMENTS

| | | | |
|---|---|---|---|
| 2839242 | 3/1980 | Fed. Rep. of Germany | 4/310 |

*Primary Examiner*—Henry J. Recla
*Assistant Examiner*—K. Kupferschmid
*Attorney, Agent, or Firm*—Joseph C. Mason, Jr.; Ronald E. Smith

[57] ABSTRACT

A plumbing fixture for installation in women's rooms that enables female individuals to urinate from a standing position. An elongate flexible hose has a urine-collecting funnel at its top end and its bottom end is in communication with a water-holding bowl that is flushed by a siphoning action. A sanitary cuff lines the rim of the funnel so that the funnel does not contact the body of the user, and the cuff is knocked off the funnel after use by a passive ejector arm when the funnel is suspended between the arms of a hanger member.

20 Claims, 5 Drawing Sheets

Fig. 1-A

URINAL FOR USE BY FEMALE INDIVIDUALS

TECHNICAL FIELD

This invention relates, generally, to plumbing fixtures of the type found in public restrooms. More particularly, it relates to a fixture that allows women to urinate while standing.

BACKGROUND ART

Long queues of people awaiting access into public restrooms for women are common sights at fair grounds, sporting events, cultural programs, and other events that attract large crowds of people. Such queues normally do not form at the site of men's rooms. Since healthy individuals of both sexes urinate in about the same length of time, the queues at the women's rooms are primarily attributable to the absence from women's rooms of plumbing fixtures of the type commonly referred to as "urinals" such as are found in men's rooms.

Urinals of the type found in public men's rooms are not installed in women's rooms because they are not adapted for the female anatomy. Accordingly, several inventors have developed urinals adapted specifically for use by women. The most highly developed urinal for use by females known heretofore is disclosed in U.S. Pat. No. 4,683,598, awarded to the present inventor in 1987. That patent contains a discussion of earlier attempts in the field, and the invention historian is referred thereto for a thorough description of said earlier efforts.

The urinal shown in the present inventor's earlier patent pioneered this important field and its claims are entitled to broad interpretation so as to protect the heart of the invention, as a matter of law.

However, the earlier device included no specific means for automatically ejecting its funnel-lining means from its funnel after use.

The earlier device also did not have the look of a standard restroom plumbing fixture. Moreover, the earlier unit was not specifically disclosed as being installed in a public restroom in the absence of a need to provide special plumbing.

Accordingly, a need remains extant for an improved urinal for women that does not require the user to touch the funnel-lining means after use and which may be installed in any public restroom without modification to the existing plumbing connections.

The prior art, taken as a whole, neither teaches nor suggests how such an improved fixture could be provided.

DISCLOSURE OF INVENTION

The present invention provides a toilet fixture having the look of a conventional public restroom fixture; such standard look will help to promote its use by adult women and by children of both sexes.

The fixture is made of isoceramics, is generally upstanding in configuration, and has a water-filled basin or bowl at its lower end that is just above floor level. As such, it has aesthetic appeal and its function and manner of use is readily understood even by someone who sees it for the first time.

Perhaps most importantly, its plumbing connections are such that it is readily installed in any preexisting public restroom; no special connections or modifications to the existing plumbing is required, as will become apparent in the detailed description that follows.

The basic structure of the fixture is quite similar to the structure of a urinal of the type used by men, i.e., a water-holding basin is at the bottom of the fixture, side walls integral to the basin project upwardly therefrom and are interconnected by a back wall and a top wall surmounts the back wall and joins the two side walls. This construction provides an open-fronted cavity bounded at its back by said back wall, at its sides by said side walls, and at its top and bottom by said top wall and bowl, respectively. A water line for admitting flushing water into the fixture is located near the top of the urinal, just as in conventional, male-dedicated urinals, and the basin is emptied into a standard sewer line by a siphoning action, just as in the common commode fixture. More particularly, the water-retaining basin or bowl empties by said siphoning action when over-filled with water.

Another important improvement to the present inventor's earlier urinal resides in the means for removing the funnel-lining means which prevents the urine-collection funnel of the present invention from contacting the body of the user of the fixture. The funnel member is suspended, when not in use, between a pair of transversely spaced apart arm members. When so positioned, it is wholly within the cavity defined by the fixture. The arm members are hingedly mounted with respect to the back wall of the fixture and are biased upwardly so that they fold upwardly when the funnel is lifted therefrom.

A single, immovably mounted arm member is spaced upwardly of one of the hingedly mounted arm members. When the funnel is returned to its storage position where it is suspended between the hingedly mounted arm members, the funnel-lining means is disengaged from the funnel by the immovable arm member. The user need not intend to dislodge the funnel-lining means; the dislodging means is entirely passive in operation and requires no manipulation or thought by the user. When dislodged, the funnel-lining means falls directly into the basin and is flushed away, along with discarded toilet paper.

Flushing water enters the fixture through a first fluid passageway formed in the substantially horizontal top wall of the unit, and exits the unit through a second fluid passageway formed in the basin that is confluent with a conventional sewer line. Third and fourth fluid passageways are formed in opposite sides of the unit and are confluent with the first fluid passageway. Flushing water entering the first fluid passageway is constrained to enter both the third and fourth fluid passageways and to travel the entire longitudinal extent of each. A plurality of vertically spaced, horizontally disposed bore means are formed along the extent of each of said third and fourth fluid passageways; accordingly, the flushing water is directed onto the side walls and back wall of the unit, rinsing said unit and aiding the flushing action.

Another plurality of substantially vertically aligned bore means are formed in a bottom wall of the first fluid passageway so that flushing water can also escape therefrom. Water flowing downwardly through said bore means impinges against and rinses the inner side walls of the funnel disposed therebelow and is ultimately collected by the basin and is operative with the other flushing water to initiate the siphoning-based flushing action of the unit.

The funnel surmounts and is confluent with an elongate flexible hose member that is confluent at its lowermost end with the basin. Thus, urine collected by the funnel is directed into the hose and flows, under the influence of gravity, down the hose and into the basin.

Advantageously, neither the hose member nor the funnel member need be touched by the user of the fixture. An elongate handle member has a forward end integral with the downspout of the funnel and a rearward end adapted to be gripped by a human hand; the handle member is inclined upwardly at a steep angle so that the grippable part thereof is positioned upwardly and outwardly of the cavity defined by the fixture.

To use the device, the handle is grasped and the funnel is lifted from its hanger. A funnel liner or sanitary cuff is inserted into lining disposition to the inner side walls and rim of the funnel and the handle is then rotated 180° to reverse the stored position of the funnel member, because the contour of the funnel matches the female anatomy when so positioned. A tab at the front of the funnel is marked "front" or uses other suitable language to educate the user as to the proper position of the funnel, but the notation is somewhat redundant since the attachment of the elongate handle to the funnel downspout makes the correct position of the funnel quite apparent.

The hose is of stainless steel, braided construction and retains its position when released. Thus, the user need not continually grip the handle once the funnel has been brought to a comfortable position, although a better fit will be attained if light pressure is applied. The memory of the hose also guards against inadvertent dropping of the funnel and prevents the funnel from falling to the floor if it is not hung properly after use or if an irresponsible or careless individual simply leaves it in its extended, unstored position. The funnel downspout and hose are suitably rotatably connected to one another to allow 360° rotation of the funnel so that the user of the device need not restrict the movement of the funnel to any particular degree or direction.

The primary object of this invention is to advance the art of urinals for female individuals. Other objects and advantages will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF DRAWINGS

For a fuller understanding of the nature and objects of the invention, reference should be made to the following detailed description, taken in connection with the accompanying drawings, in which:

FIG. 1A is a top plan view of the funnel of this invention;

Similar reference numerals refer to similar parts throughout the several views of the drawings.

BEST MODES FOR CARRYING OUT THE INVENTION

Figure 1:
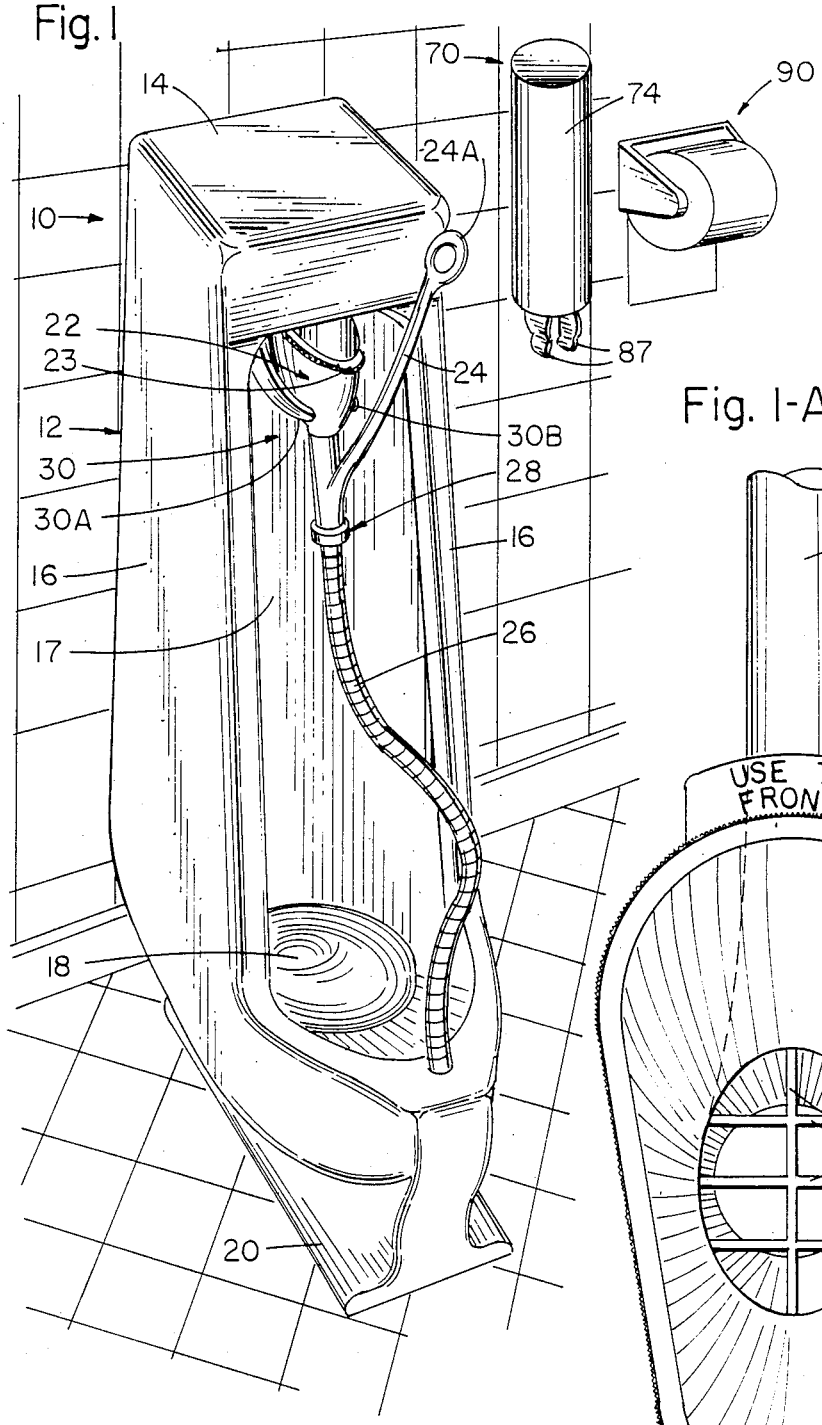
FIG. 1 is a perspective view of an exemplary embodiment of the invention.
Figure 1:
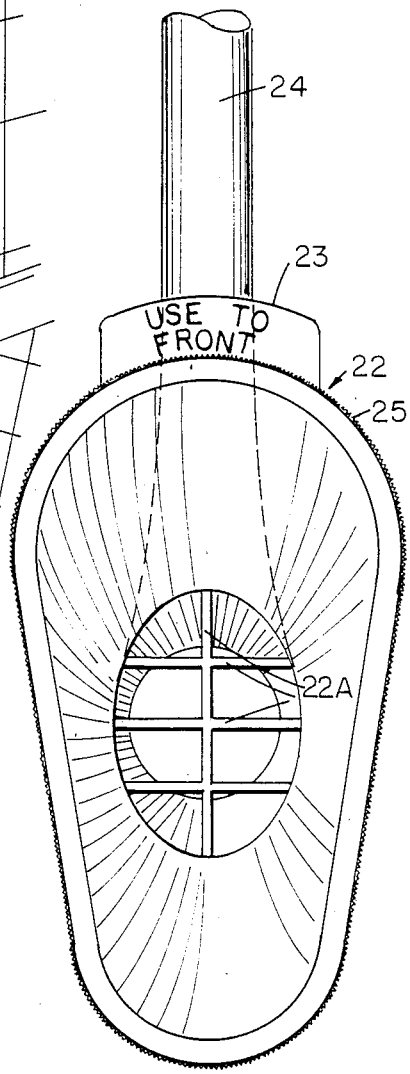

FIG. 1 shows the urinal 10 as it would appear to an individual approaching it. Fixture 10, to be known commercially as the She-inal TM, has an open front as shown and includes a main body 12, top wall 14, side walls 16, back wall 17, bowl 18, base 20, receptor funnel 22, funnel handle 24, hose 26, hose connection 28 and funnel hanger 30. A sanitary cuff dispenser 70 and a toilet tissue dispenser 90 are also shown. Hanger 30 is adhered to back wall 17 by a suitable adhesive means, not shown, as perhaps best understood in connection with FIG. 3.

Figure 2:
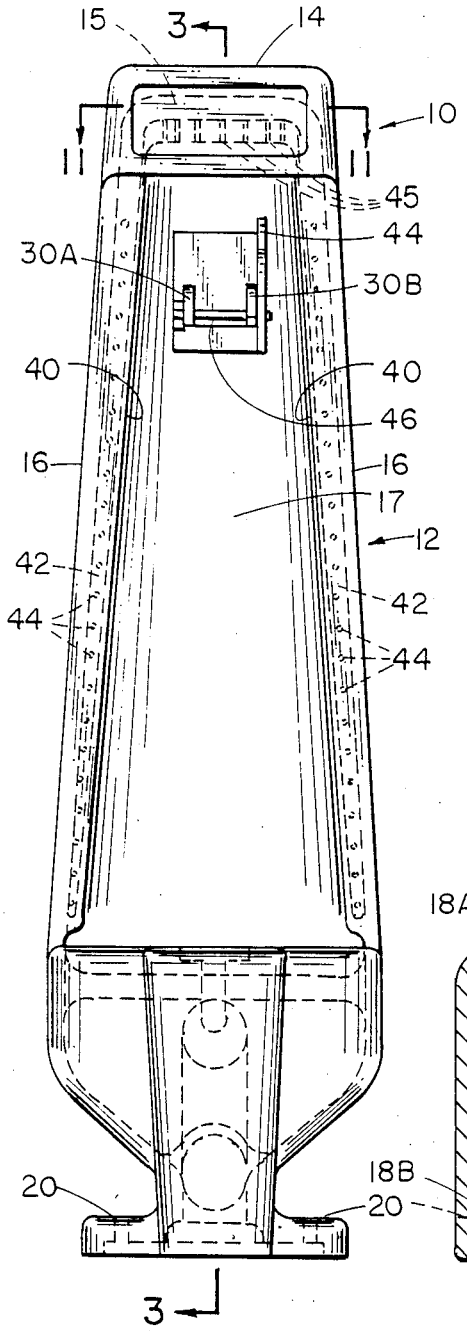
FIG. 2 is a front elevational view of the novel fixture.
Figure 3:
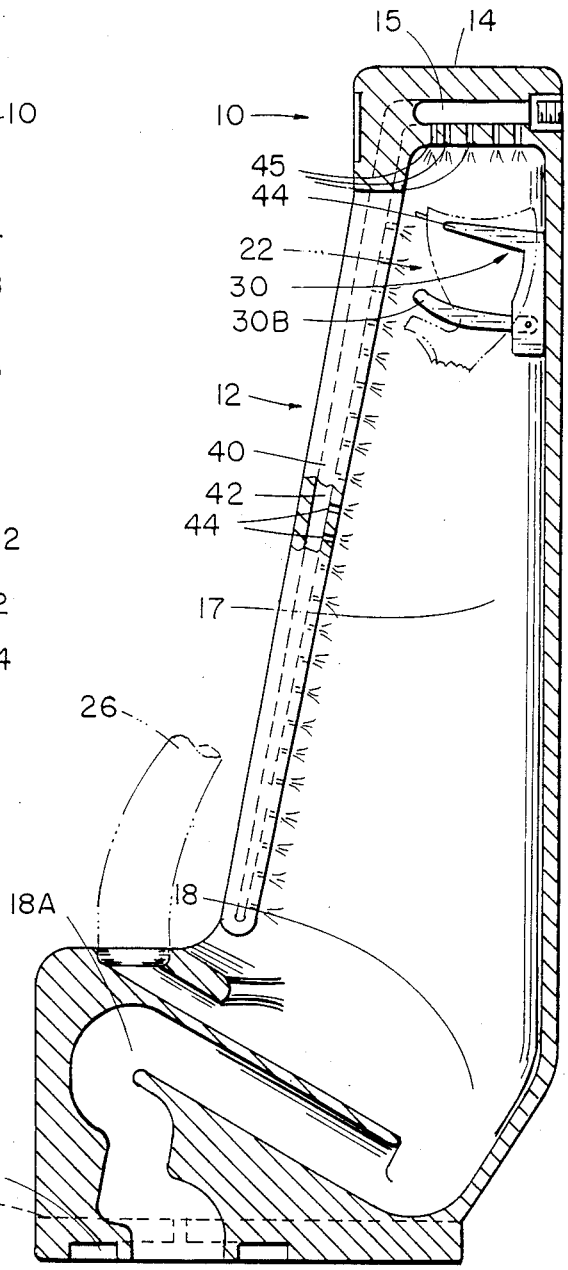
FIG. 3 is a sectional view taken along line 3—3 in FIG. 2.

As perhaps best shown in FIGS. 2 and 3, the forward ends of side walls 16 are turned ninety degrees inwardly to form forward walls 40, each of which houses a tapered central manifolded fluid passageway 42 containing a multiplicity of spray holes or vertically spaced, generally horizontally disposed bore means 44 which are directed toward the inside surfaces 17 of the side walls 16 and the forward surface of the back wall to rinse said walls during the flushing cycle. A manifolded cavity 15 is formed within top wall 14 and is in fluid communication with the two fluid passages 42, said cavity 15 being the primary receptor of the water supply from the flush valve 60 shown in FIG. 6.

Figure 11:
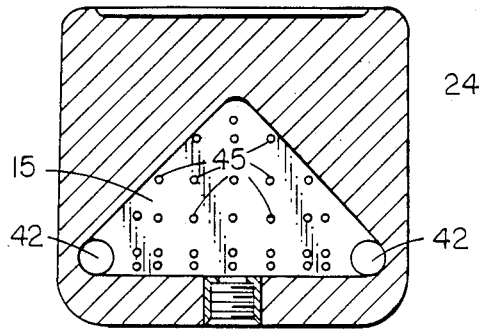
FIG. 11 is a sectional view taken along line 11—11 in FIG. 2.

FIG. 11 is a sectional view showing the manifold cavity 15 communication with the manifolded holes 42 and the spray holes 45.

In the claims that follow, cavity 15 is referred to as a first fluid passageway means and the manifolded fluid passageways 42, 42 are referred to as third and fourth fluid passageway means; the second fluid passageway means interconnects bowl 18 and a sewer line.

The spray holes or bore means 45 are directed downwardly to rinse the inner portions of the receptor funnel 22 during the flushing cycle as well as the rear wall of the fixture. FIGS. 2 and 3 also clearly show the disposition of the hanger mechanism 30 wholly within the cavity of the main body 12, while FIG. 3 more particularly shows the cross-sectional configuration of the siphon part **18*a* of the waste bowl 18. Note that the lowermost end of hose 26 is above the plane of the water in bowl 18, as suggested in FIG. 3 and shown in FIG. 1**.

Figure 4:
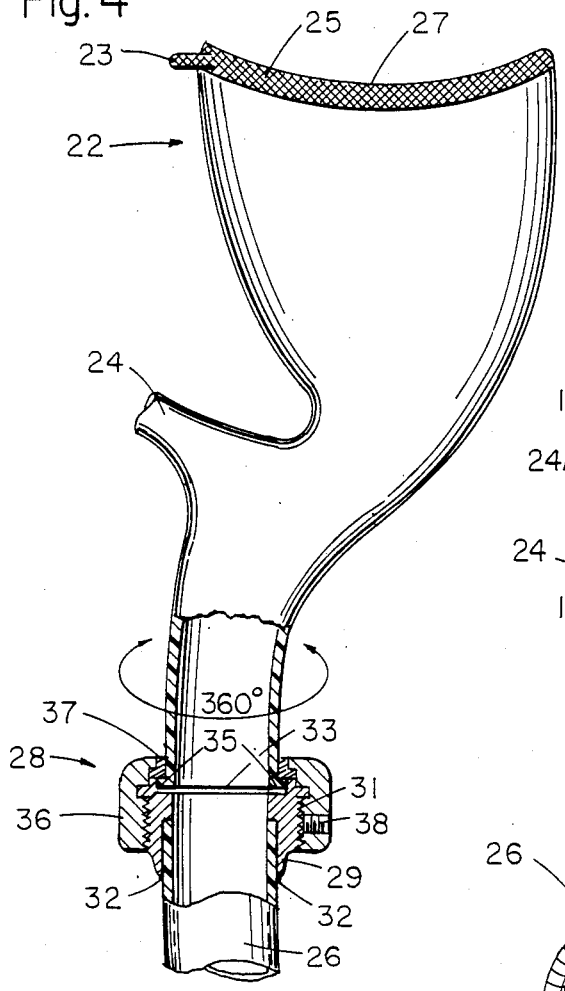
FIG. 4 is a side elevational and partially sectional view of the novel funnel.

In FIG. 4, the side elevational view of the receptor funnel 22 shows the forward indicator tab 23 and the outer knurled or otherwise roughened surface 25 of the upper edges 27 of the funnel. The 360° downspout-tohose connector 28 is detailed in the cross-sectioned part of FIG. 4. It includes an annular fitting 29, externally threaded at 31, permanently affixed to the hose 26 by means of welding, soldering, or the like as indicated at 32. A plastic flat washer 33, made of a bearing type of plastic such as Teflon® lies between an annular shoulder 34 of the fitting 29 and the external annular lip 35 of the bottom part of the funnel 22 to provide 360° rotatability of the funnel. The components above described are secured together by an internally threaded retention nut 36, sealed by a rubber or Neoprene® gasket 37. The retention nut 36 is itself secured from unthreading by a conventional set-screw 38.

Figure 5:
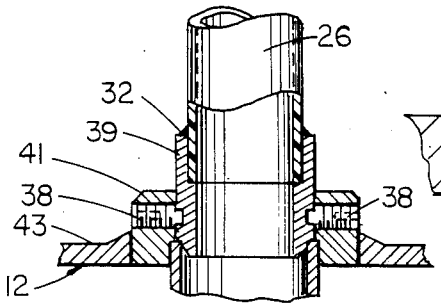
FIG. 5 is a sectional view showing the coupling of the flexible hose to the base of the fixture.

FIG. 5 discloses the manner in which the bottom end of the hose 26 is fastened to the lower part of the body 12. This consists of a permanently affixed annular fitting 39 at the bottom end of the hose 26 which is inserted into a raised boss 41 of the planar part 43 of the lower part of the body 12 and which is secured by opposing set screws 38. Hose 26 has an outer stainless steel metallic flexible braided casing which allows the hose to remain upright in any position in which it is left at any given time.

Figure 6:
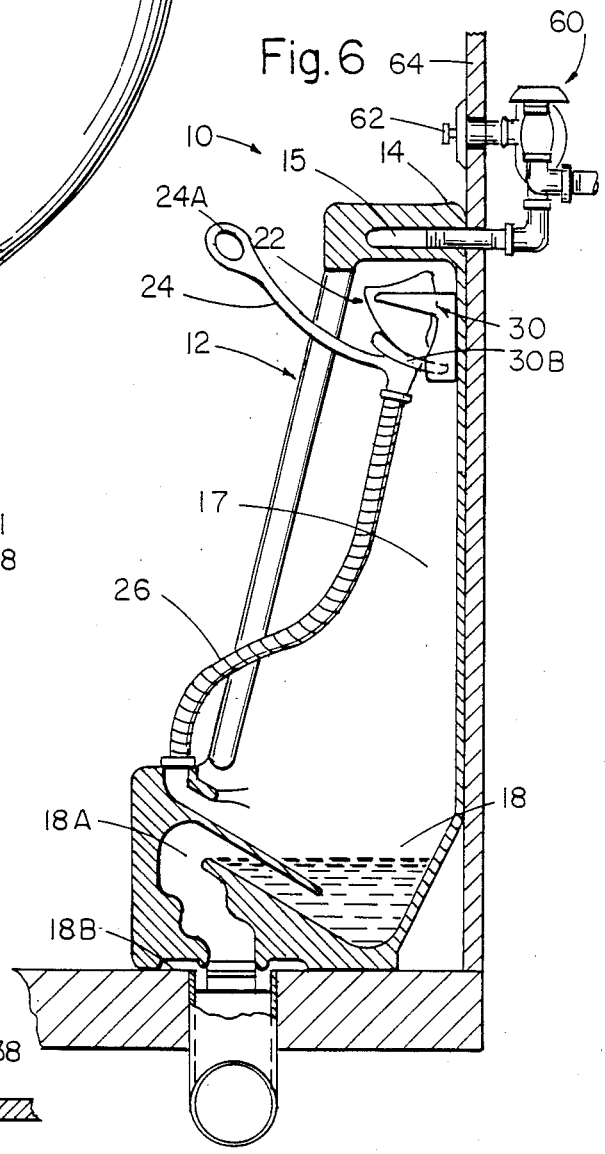
FIG. 6 is a sectional view similar to that of FIG. 3 but also showing the plumbing connections associated with the novel fixture.

FIG. 6 discloses a flush button 62 of the flush valve mechanism 60 attached through wall board 64. As mentioned before, the piping from the flush valve 60 is in fluid communication with the manifolded cavity 15 formed in top wall 14 of the body 12. The siphon part **18*a* of the bowl 18 is confluent with the floor flange 18*b***.

Figure 7:
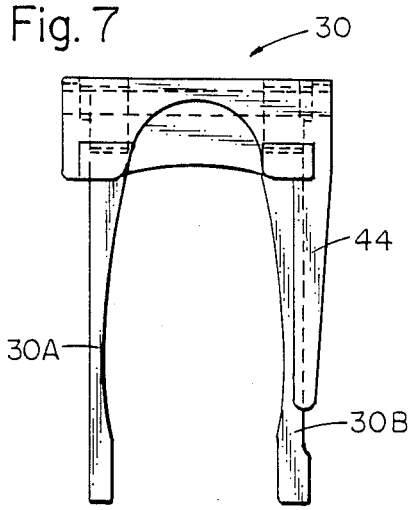
FIG. 7 is a top plan view of the cradle means that supports the funnel.
Figure 8:
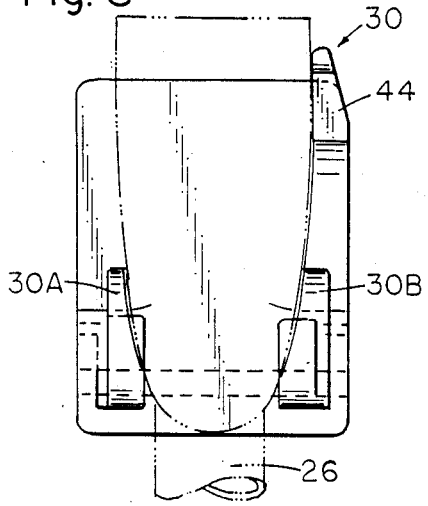
FIG. 8 is a front elevational view of the cradle means of FIG. 7, showing the funnel in phantom lines.
Figure 9:
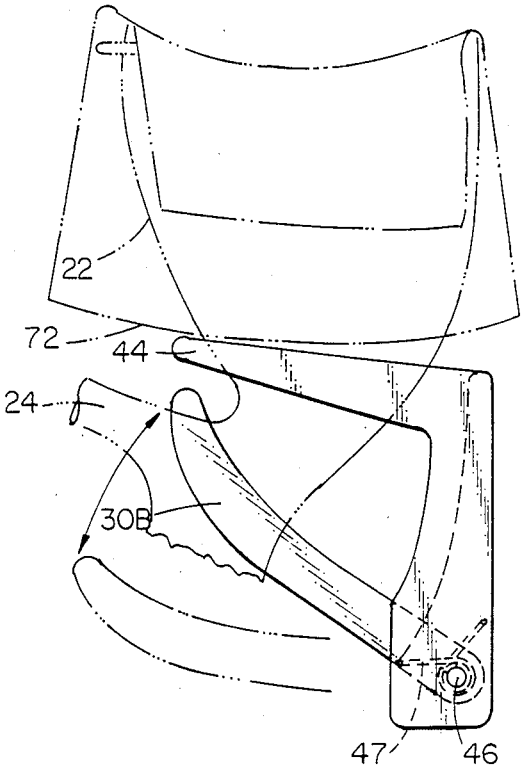
FIG. 9 is a side elevational view of the funnel member being inserted into the cradle means.
Figure 10:
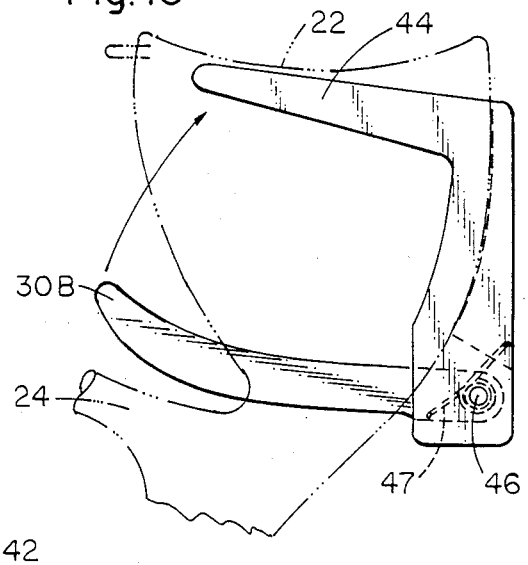
FIG. 10 is a side elevational view of the cradle means when the funnel is inserted thereinto, said funnel being shown in phantom lines.

FIG. 7 is a top view of the funnel hanger apparatus 30. Hanger 30 includes the hinged, bifurcated, transversely spaced apart arms **30*a* and 30*b* and the fixed single arm ejector 44. FIG. 8 is a front elevational view of the hanger apparatus and FIG. 9 is a side elevational view thereof, clearly showing how fixed arm ejector 44 engages one side of the sanitary cuff 72, flipping it off of the funnel 22 when said funnel is re-hung, thereby dropping it into the bowl 18 without the need of ever handling the used cuff 72. More particularly, FIG. 9 shows, in phantom lines, how the funnel liner 72 initially avoids ejector arm 44. Note that the lowermost edge of said liner is positioned above said arm 44. Thus, as the funnel is lowered into its FIG. 10 position, said lowermost edge of liner 72 is engaged by said arm 44 and ejected from funnel 22. Since the ejector arm 44 is only located on one side of the funnel 22 the arm causes an instability in the liner by engaging the liner lowermost edge 72 thereby causing the liner to fall from the side of the funnel opposite the arm into the bowl due to gravity. FIG. 8 makes it clear that once funnel 22 is seated between hingedly mounted arms 30*a*, liner 72 cannot possibly remain in lining relation thereto. As the funnel 22 is lowered onto the bifurcated arms 30*a* and 30*b*, the collective weight of the funnel 22 and hose 26 overcomes the bias of the springs 47 coiled around the pintle 46 of the hanger mechanism, as more clearly seen in FIG. 10. Thus, the action of ejector arm 44 is entirely passive in operation. It should be understood that arms 30*a*, 30*b* are biased upwardly to require the user to position the funnel above said arms as depicted in FIG. 9 when the funnel is being re-hung after use. In this manner, the funnel-lining means 72 initially avoids ejector arm 44 and said means, being formed of paper, is not crumpled. If funnel 22 were inserted into its FIG. 10 position in a horizontal motion, then arm 44 would crumple the paper 72 and not eject it. The upraised arms thus ensures that ejector arm 44 will sweep the outer wall of the funnel as said funnel is re-hung, thereby knocking the funnel-lining means into bowl 18**. Advantageously, the user need not intend such result.

FIG. 1A discloses a part of the handle 24, forward indicator tab 23, the knurled or roughened outer edge 25 of the rim of the funnel 22, and a gridwork **22*a*** that acts as a large screen to prevent larger objects from clogging the hose.

Figure 12:
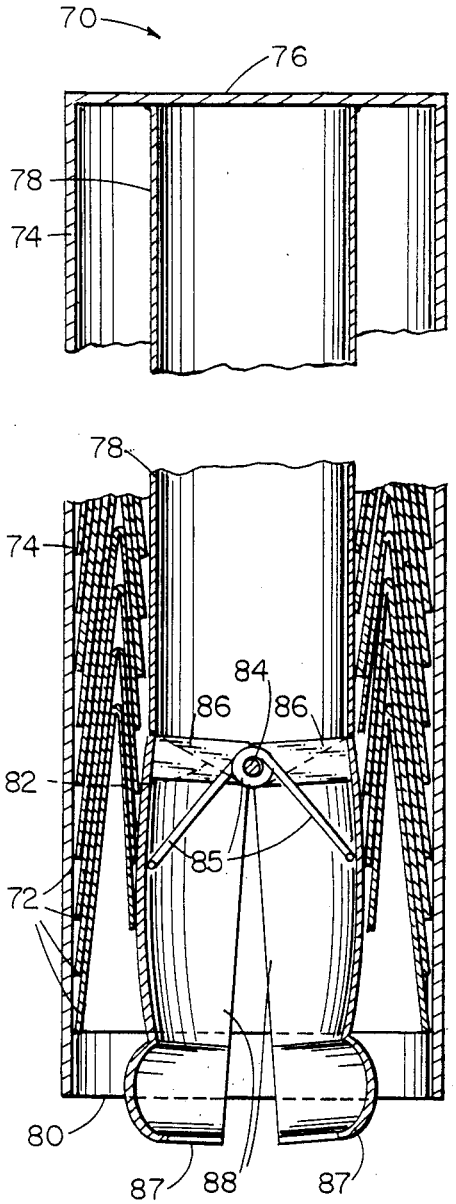
FIG. 12 is a sectional view of the novel dispenser means.
Figure 13:
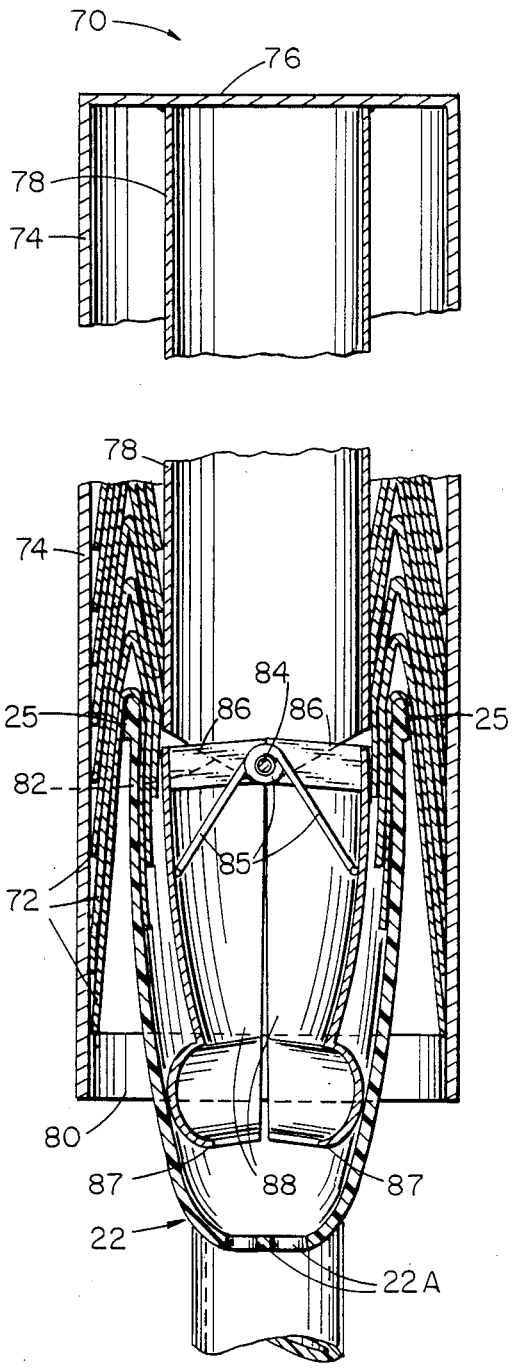
FIG. 13 is a view similar to that of FIG. 12, but showing the funnel member disposed within the dispenser means to engage a sanitary cuff.

FIGS. 12 and 13 are cross-sectional views of the sanitary cuff dispenser 70. Dispenser 70 consists of an outer oval shaped tube or housing 74 with a permanently affixed top 76 and a permanently affixed inner oval tube 78, more or less concentrically located within the outer tube 74, attached at the underside of the top 76, leaving a means of loading the dispenser 70 from the bottom 80. Referring now to FIG. 12, the lower end 82 of the tube 78 terminates at 82 with a pintle 84 running fore and aft of the tube 78 about which are two pairs of legs 86 attached to two split tubes 88, said split tubes being urged outwardly by a coil spring 85. Tubes 88 are generally of the same oval configuration of the main tube 78 except that they terminate with indented curved ends 87. FIG. 12 shows that the outwardly urged split tubes 88 serve to retain the folded cuffs 72 within the dispenser, because the main tube 78 and the split tubes 88 conform to the inside oval openings of the sanitary cuffs 72.

Referring now to FIG. 13, the funnel 22 is inserted upwardly into the dispenser 70 and as the tapered lower end of the funnel engages the curved ends 87 of the split tubes 88, they overcome the outward urging of the spring 85, releasing and indexing one cuff 72 onto the funnel 22. The knurled outer edges 25 of the funnel 22 tend to grip a singular cuff 72 and as the funnel is lowered, the split tubes 88 once again are urged outwardly to grip the succeeding cuff 72, thereby providing an automatic means of dispensing a cuff 72 onto the funnel 22 without having to physically handle the cuffs or the funnel itself. The cuffs remain enclosed at all times within the dispenser, eliminating exposure or handling by the public which could possibly contaminate the new cuffs. Dispenser 70 may be constructed of transparent material or a vertical transparent window in front of the dispenser 70 can give a visual revelation of the amount of cuffs remaining therein.

From the foregoing one can readily understand how a person can remove the funnel 22 from its hanger 30, engage a sanitary cuff or funnel-lining means 72 at the bottom of the dispenser 70 without touching either the funnel or the cuff, rotate the funnel 22 by means of the handle 24, and place the funnel below the vulvar region for urination by the user, after which the user rotates the funnel 180°, placing it in the hanger 30, ejecting the cuff 72 automatically, again, without ever touching the cuff or the funnel. Upon pushing the flush button 62, the inner walls of the funnel, the walls of the urinal, the hose and the bowl are rinsed and the cuff, toilet tissue, tampons or other waste are flushed down the bowl with its attendant siphon flow, using a minimum of water (approximately one gallon as distinguished from three gallons, more or less, required in conventional water closets).

The forwardly extending handle 24 of the funnel 22 is extended approximately twelve inches forward in an upwardly curving manner with a loophole **24*a*** at its distal end for the purpose of allowing obese or pregnant women to utilize the device with ease. It also allows an adult to handle it with a small child without having to come too close to the vulvar region with the hands. The loophole enables a person with manual handicaps to insert one or more fingers thereinto, thereby facilitating its use without a firm grip on the device.

The exterior of the hose is covered with a Neoprene sleeve to preclude exterior contamination of the grooves and crevices on the braided part of the hose. The interior of the hose has a PVC lining to reduce bacterial contamination therein.

Importantly, the She-inal TM can be installed in any restroom with conventional plumbing connections. Therefore, as "potty parity" laws are passed, requiring urinals in women's rooms, the She-inal TM will enable property owners to easily comply with such laws.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A plumbing fixture for use primarily in public restrooms, comprising:

a substantially vertical back wall, a pair of substantially vertical side walls integral to opposite edges of said back wall, said side walls projecting forwarding from said back wall in substantial parallelism to one another, a substantially horizontal top wall disposed in surmounting relation to said side walls and said back wall and being integral with said side and back walls, a water-retaining bowl means integral to respective lower ends of said back and side walls, and said fixture having an open front;

said bowl means, back wall, side walls and top wall collectively forming a cavity;

a first fluid passageway means being formed in said top wall;

said first fluid passageway means being disposed in fluid communication to a preexisting water line that provides flushing water to toilet fixtures;

a second fluid passageway means being formed in said bowl means;

said second fluid passageway means having a configuration that enables a siphoning action flush of said fixture in response to opening said water line;

said second fluid passageway means being in fluid communication to a preexisting sewer line; and said fixture being floor-mounted and said bowl means being positioned in closely spaced relation to a floor;

a funnel member having a rim and a downspout;

an elongate flexible hose having a lowermost end in open fluid communication with said bowl means, above the plane of water in said bowl, and an uppermost end in open fluid communication with said downspout;

a hanger means for supporting said funnel member when not in use;

said hanger means being mounted to said back wall;

said top well being disposed in overhanging relation to said funnel member when said funnel member is supported by said hanger means;

said funnel member being wholly positioned within said cavity when so supported;

an elongate handle means having a first end integral with said funnel downspout and a second end adapted to be grasped by a human hand;

said handle means having a predetermined length sufficient to position said second end thereof external to said cavity so that a riser of said fixture need not reach into said cavity to remove said funnel member from its support;

said hanger means including a pair of transversely spaced apart arm members, said arm members being spaced from one another by a predetermined distance that is slightly less than a predetermined width of said funnel member so that said funnel member is suspendedly supported by said arm members when disposed therebetween;

a disposable funnel-lining means adapted to overlie the rim of said funnel member so that only said funnel-lining means contacts the body of the individual employing said fixture; and removal means for ejecting said funnel-lining means from said funnel member when said funnel member is re-hung on said hanger means after use.

2. The fixture of claim 1, wherein each of said side walls has a forward edge bent substantially 90° in an inwardly direction toward the opposite side wall forward edge, said inwardly bent forward edges respectively forming first and second forward walls of said fixture.

3. The fixture of claim 2, further comprising:

a third fluid passageway means being formed in said first forward wall of said fixture;

a fourth fluid passageway means being formed in said second forward wall of said fixture;

each of said third and fourth fluid passageway means having an upper end confluent with said first fluid passageway means and further having a closed lower end formed adjacent a lower end of their respective forward walls;

a first plurality of vertically spaced, generally horizontally disposed bore means, each of which has a first, forward end disposed in fluid communication with said third fluid passageway means and a second rearward end disposed in open communication with a rear edge of said first forward wall; and a second plurality of vertically spaced, generally horizontally disposed bore means, each of which has a first, forward end disposed in fluid communication with said fourth fluid passageway means and a second rearward end disposed in open communication with a rear edge of said second forward wall;

whereby when said flushing water line is open, water flows into said first fluid passageway means and hence to said third and fourth fluid passageway means and out said first and second plurality of bore means so that it impinges upon interior surfaces of said side walls and a forward surface of said back wall, said water ultimately entering said bowl means and initiating a siphoning flushing action through said second fluid passageway means.

4. The fixture of claim 3, further comprising a plurality of substantially vertically disposed bore means, each of said vertically disposed bore means having an upper end confluent with said first fluid passageway means and a lower end in open communication with a bottom surface of said top wall so that when said flushing water line is open, water enters said first fluid passageway means and travels through said plurality of vertical bore means to thereby rinse any element disposed under said top wall.

5. The fixture of claim 1, wherein said arm members are hingedly mounted at their respective rearward ends to said back wall of said fixture, near an uppermost end of said back wall, and further comprising bias means for urging said arm members to hindgedly fold upwardly when said funnel member is not positioned therebetween, said funnel member and said hose member having a sufficient collective weight to overcome said bias means so that said arm members are generally horizontally disposed when said funnel member is supported by said arm members.

6. The fixture of claim 5, wherein said removal means includes a third arm member disposed upwardly of a preselected arm member of said pair of arm members, said third arm member being immovably mounted and said third arm member projecting forwardly from said back wall of said fixture in a subtantially horizontal plane so that said funnel-lining means is knocked off the rim of said funnel member by said third arm member when said funnel member is placed between said pair of arm members, said funnel-lining means falling into said bowl means upon being ejected from said funnel member.

7. The fixture of claim 6, wherein said funnel-lining means includes a main body part specifically configured to be at least partially inserted into said funnel member and further includes a rim-engaging part that overlies said funnel rim.

8. The fixture of claim 7, further comprising a dispenser means for holding a plurality of said funnel-lining means disposed in stacked, nested relation to one another so that said funnel-lining means are individually separable from one another when removed from said dispenser means.

9. The fixture of claim 8, wherein said rim of said funnel member has a roughened surface and wherein said funnel-lining means is formed of a predetermined type of paper so that said roughened surface frictionally engages said funnel-lining means when said rim abuts said funnel-lining means.

10. The fixture of claim 9, wherein said dispenser means includes a housing of generally tubular configuration, a generally concentrically mounted inner tubular member disposed within said housing, a split tubular member having opposite parts, a bias means for urging said opposite parts radially outwardly from one another, said split tubular member being disposed in depending relation to said inner tubular member;

a plurality of said funnel-lining means being disposed in nested, stacked relation to one another in said dispenser means;

an outer part of each of said funnel-lining means bearing against an inner surface of said dispenser housing;

an inner part of said funnel-lining means in an upper part of said dispenser means bearing against an outer surface of said inner tubular member;

the inner part of said funnel-lining means in a lower part of said dispenser means bearing against an outer surface of said split tubular member;

whereby said bias means urges said opposite parts of said split tubular member radially outwardly with respect to one another, thereby compressing the inner and outer parts of said funnel-lining means in the lower part of said dispenser means toward one another and preventing the funnel-lining means in the lower part of said dispenser means from falling out of said dispenser means, said funnel-lining means in the upper part of said dispenser means being supported by the funnel-lining means in the lower part of said dispenser means.

11. The fixture of claim 10, wherein said split tubular member is specifically dimensioned so that when its opposite parts are radially spaced apart from one another under the influence of said bias means, said opposite parts are spaced sufficiently close to one another to be received within said funnel member;

whereby a single funnel-lining means is removed from said dispenser means by manipulating said funnel handle means to position said funnel rim in surrounding relation to the opposite parts of said split tubular member, lifting said funnel upwardly so that said split tubular member is slidably received therein and so that the radially outwardly directed bias supplied by said bias means is overcome by said funnel and said opposite parts are driven by said funnel in a radially inwardly direction toward one another, said roughened surface of said funnel rim frictionally engaging the outer part of a lowermost funnel-lining means in said stack of funnel-lining means;

whereby removing said funnel from said dispenser means carries a single funnel-lining means therefrom in its seated relation to said funnel; and whereby removing said funnel from said dispenser means allows the bias means to again urge said opposite parts of said split tubular member in a radially opposite direction relative to one another to thereby retain subsequent funnel-lining means within said dispenser means.

12. The fixture of claim 1, wherein said flexible hose is of braided construction and retains its configuration when released.

13. The fixture of claim 12, wherein an uppermost end of said hose is rotatably secured to said downspout.

14. A plumbing fixture, comprising:

a funnel having a rim and a downspout;

a hanger means for said funnel, said hanger means including a pair of transversely spaced apart arm members that suspendedly support said funnel when said funnel is positioned therebetween;

an elongate handle formed integrally with said downspout;

said handle projecting radially outwardly and upwardly with respect to said downspout so that a distal free end of said handle is disposed upwardly of said funnel rim when said funnel is hung on said hanger means;

an elongate flexible hose being rotatably secured at its uppermost end to a lowermost end of said downspout;

a water-retaining bowl that empties by a siphoning action when over-filled with water;

a lowermost end of said hose being disposed in fluid communication with said bowl;

a back wall member being formed integral with a rearward part of said bowl and said back wall member projecting upwardly therefrom;

a generally horizontal top wall that surmounts said back wall;

said pair of arm members being hingedly mounted, in coplanar relation to one another, to said back wall member and said pair of arm members being positioned wholly within said cavity;

a bias means for urging said pair of arm members to fold upwardly relative to said bowl means when said funnel is not suspended therebetween;

said funnel being wholly positioned within said cavity when said funnel is supported by said arm members;

said handle having a predetermined extent sufficient to position its distal free end wholly without said cavity;

a sanitary cuff for lining inner and outer sidewalls of said funnel; and cuff removal means for electing said sanitary cuff from said funnel when said funnel is placed into suspended relation between said transversely spaced apart arm members.

15. The fixture of claim 14, wherein said cuff removal means includes a third arm member specifically positioned relative to said transversely spaced apart arm members to dislodge said cuff from said funnel when said funnel is placed into suspended relation between said transversely spaced arm members.

16. The fixture of claim 15, further comprising:

a pair of side walls integral with said top wall, said back wall and said bowl;

a cavity bounded at its top by said top wall, at its back by said back wall, at its side by said side walls, and at its bottom by said bowl;

a first said fluid passageway being formed in said top wall to admit water from an external source of water into said top wall; and a plurality of vertically aligned bore means being formed in a bottom of said top wall so that water in said first fluid passageway exits said top wall through said bore means.

whereby said water flowing through said bore means rinses said funnel when said funnel is suspended between said transversely spaced apart arm members and initiates the siphoning action that empties said bowl.

17. The fixture of claim 15, wherein a forward edge of each of said side wall members is bent ninety degrees toward the opposite side wall member to thereby form a pair of transversely spaced forward wall members that are disposed in substantial parallelism to said back wall member, wherein an elongate, manifolded bore means is formed in each of said forward walls substantially along the entire respective extents thereof, wherein each of said manifolded bore means has an upper end in fluid communication with said first fluid passageway so that water entering said first fluid passageway also enters both of said manifolded bore means, wherein each of said manifolded bore means has a closed lower end, wherein a plurality of vertically spaced, generally horizontally disposed bore means have their respective inner ends in open fluid communication with their respective manifolded bore means, and wherein each of said horizontally disposed bore means have their respective outer ends in open communication with a back wall of their associated forward wall members so that water entering said manifolded bore means is constrained to exit therefrom through said horizontally disposed bore means, thereby rinsing inner surfaces of said side wall members and at least a part of the forward surface of said back wall member and initiating the siphoning action that empties said bowl.

18. The fixture of claim 14, wherein said flexible hose is of braided construction and retains its configuration when released.

19. The fixture of claim 18, wherein an uppermost end of said hose is rotatably secured to said downspout.

20. A urinal, comprising:

a free standing plumbing fixture having a floor-mounted base, a water-retaining bowl formed in said base that is positioned just above a floor that supports the fixture, said bowl being emptiable by a siphoning action and being adapted to handle the disposal of toilet paper, tampons and the like, a vertically extending back wall integrally formed with said base, a pair of laterally spaced side walls integral with said back wall and with said base, a horizontally extending top wall that caps a cavity defined at its lowermost end by said bowl and at its back and sides by said back and side wall members;

a hanger member disposed in said cavity;

a funnel having a downspout, said hanger being adapted to hold said funnel when said funnel is not is use;

an elongate, radially extending handle means having a first end attached to said funnel and a second end extending out of said cavity;

an elongate flexible hose having an upper end in fluid communication with said funnel and a lower end in fluid communication with said bowl;

said hanger member including a pair of transversely spaced apart arm members, said arm members being spaced from one another by a predetermined distance that is slightly less than a predetermined width of said funnel member so that said funnel member is suspendedly supported by said arm members when disposed therebetween;

a disposable funnel-lining means adapted to overlie the rim of said funnel member so that only said funnel-lining means contacts the body of the individual employing said fixture; and removal means for ejecting said funnel-lining means from said funnel member when said funnel member is re-hung on said hanger means after use.

* * * * *